United States Patent [19]

Ashburner

[11] Patent Number: 4,484,905

[45] Date of Patent: Nov. 27, 1984

[54] ZIG-ZAG FOLDING MACHINES

[75] Inventor: Adi K. Ashburner, Hargrave, England

[73] Assignee: Harper & Tunstall Limited, Northamptonshire, England

[21] Appl. No.: 328,588

[22] PCT Filed: Feb. 3, 1981

[86] PCT No.: PCT/GB81/00010

§ 371 Date: Nov. 25, 1981

§ 102(e) Date: Nov. 25, 1981

[87] PCT Pub. No.: WO81/02881

PCT Pub. Date: Oct. 15, 1981

[30] Foreign Application Priority Data

Mar. 31, 1980 [GB] United Kingdom ..... 8010812

[51] Int. Cl.[3] ..... B65H 45/14

[52] U.S. Cl. ..... 493/415; 493/419; 493/440; 493/461

[58] Field of Search ..... 493/435, 434, 437, 421, 493/420, 419, 413, 415, 443, 444, 442, 461, 451

[56] References Cited

U.S. PATENT DOCUMENTS

| | | | |
|---|---|---|---|
| 1,679,985 | 8/1928 | Mentges | 493/420 X |
| 1,709,282 | 4/1929 | Rader . | |
| 2,750,186 | 6/1956 | Bruneau | 493/444 X |
| 3,466,027 | 9/1969 | Kwik, Jr. | 493/413 |
| 3,476,379 | 11/1969 | Weir | 493/437 X |
| 3,747,917 | 7/1973 | Roda | 493/419 |
| 4,095,779 | 6/1978 | Imagi et al. | 493/419 X |

FOREIGN PATENT DOCUMENTS

| | | |
|---|---|---|
| 124637 | 10/1901 | Fed. Rep. of Germany . |
| 962258 | 4/1957 | Fed. Rep. of Germany . |
| 2110964 | 12/1971 | Fed. Rep. of Germany . |
| 2227582 | 1/1974 | Fed. Rep. of Germany . |
| 842423 | 3/1939 | France . |

OTHER PUBLICATIONS

Van Der Grinten Bulletin, published Jun. 22, 1967, (Venlo, NL), "Inrichting voor het vouwen van vellen en banen", pp. 5–7.

*Primary Examiner*—James F. Coan

*Attorney, Agent, or Firm*—Shapiro and Shapiro

[57] ABSTRACT

First and second parallel folding rollers (6 and 7) respectively co-operate with third and fourth folding rollers (4 and 5) of folder means to form first and second folding devices (4, 6 and 5, 7). Non-return feed rollers (8 and 9) are mounted between the first and second folding rollers (6 and 7) for folding pliable strip material (3) alternately to the two folding devices (4, 6 and 5, 7) and an intermediate part (14) of the folder means extends between the third and fourth folding rollers (4 and 5) so as to act as a guide for the pliable strip material (3). Movable guide means (12) are operable to deflect the leading end (24) of the pliable strip material (3) towards the first folding devices (4 and 6).

8 Claims, 5 Drawing Figures

ZIG-ZAG FOLDING MACHINES

TECHNICAL FIELD OF THE INVENTION

The invention relates to Zig-Zag folding machines for the concertina-like folding of pliable strip material, suitable for use in folding engineering drawings and the like.

BACKGROUND ART

As disclosed in the van der Grinten Bulletin of June 22, 1967, one known form of Zig-Zag folding machine comprises folder means having first and second parts; first and second spaced folding rollers respectively cooperable with the first and second parts of the folder means to form first and second spaced folding devices; non-return feed means which prevent return movement of pliable strip material fed between the first and second spaced rollers; and movable guide means for directing the pliable strip material towards at least one of the spaced folding devices.

In this prior art folding machine, the first and second parts of the folder means respectively constitute third and fourth folding rollers and the folder means include an intermediate part extending between the third and fourth folding rollers and providing a fixed guide surface for the pliable strip material. The non-return feed means of this machine comprises a pair of feed rollers disposed upstream of the first and second folding rollers, at the entrance of the path of the pliable strip material between the first and second folding rollers. The movable guide means of the machine constitute an oscillatory guide extending from a fixed guide which extends downstream from the feed rollers and is movable between two positions in which the pliable strip material is directed, respectively, into the nip between the first and third folding rollers and into the nip between the second and fourth folding rollers.

In operation, the first and second folding rollers always rotate in the same direction as each other, first one way and then the other. The third and fourth rollers always rotate in the opposite direction to the first and second rollers. The first and second folding devices therefore alternate in rotating in such a way as to provide a folding nip for the pliable strip material from the feed rollers.

To start the folding operation, the oscillatory guide is pointed towards the first and third folding rollers which are rotated in such a way as to provide a folding nip and the leading end of the strip material is fed between the feed rollers, through the oscillatory guide and between the first and third rollers constituting the first folding device. All the folding rollers are then stop and rotated in the opposite direction and the oscillatory guide is swung away from its initial position until it is pointing towards the second and fourth folding rollers. As a result of the continuing operation of the feed rollers and the reverse rotation of the first and third folding rollers, a loop is formed in the pliable strip material and this loop is fed into the nip between the second and fourth folding rollers to form a first fold. All the folding rollers are then stop once again and then rotated in the first direction. Another loop is formed in the pliable strip material and this loop is fed into the nip between the first and third folding rollers to form a second fold. Third, fourth and subsequent folds may be formed in a completely analogous manner.

However, difficulty is encountered in providing means for synchronising movement of the oscillatory guide with the changes in direction of rotation of the folding rollers and with the rate at which slack is formed in the pliable sheet material so as to result in the controlled formation of loops which are fed alternately between the rollers of the first and second folding devices. It is therefore impossible to obtain completely accurate folding with adjacent folds lying on top of each other.

In a less complex, less costly, less bulky and less difficult to operate folding machine of similar construction, disclosed in U.S. Pat. No. 3,747,917, the first and second parts of the folder means comprise peripherally spaced portions of a single roller or spaced portions of an endless band trained around two parallel rollers. The non-return feed means of this machine do not feed the pliable strip material between the first and second rollers and into the nips provided by the first and second folding devices, but allow this movement and prevent movement of the pliable strip material in the opposite direction. Finally, the movable guide means of this machine are provided by an intermediate part of the folder means extending between the first and second parts. Thus, in one embodiment, the movable guide means are provided by a circumferential portion of the single roller and in another embodiment the movable guide means are provided by a part of the endless band providing the first and second parts of the folder means.

Thus, as the leading edge of the pliable strip material is fed between the first and second rollers and into engagement with the intermediate part of the folder means, movement of the folder means deflects the leading edge of the pliable strip material into which ever of the nips between the first and second folding devices towards which the intermediate parts is moving. In this way, as with the oscillatory guide, the first fold is formed at a predetermined distance from the leading edge of the pliable strip material.

Unfortunately, the intermediate part of the folder means does not provide positive guidance for the pliable strip material and, because the speed of the intermediate part of the folder means is limited to the speed at which the pliable strip material is fed into the first and second folding devices, there is unwanted slippage between the pliable strip material and the intermediate part of the folder means and this results in inaccurate folding.

DISCLOSURE OF THE INVENTION

It is intended, by means of the present invention, to provide a Zig-Zag folding machine having a movable guide which is more effective in directing the pliable strip material into the nips of the first and second folding devices than in prior art machines and yet not so difficult to control as the known oscillatory guides.

This objective is provided by ensuring that the first and second parts of the folder means comprise third and fourth rollers; the folder means include an intermediate part between the first and second parts; and the movable guide means are mounted between the third and fourth folding rollers and capable of movement relative to the intermediate part of the folder means.

Thus, according to the invention, there is provided a Zig-Zag folding machine, for the concertina-like folding of pliable strip material, comprising folder means having first and second spaced folding rollers rotatable about parallel axes, folder means having third and fourth folding rollers and an intermediate part extending between the third and fourth folding rollers, the third and fourth folding rollers being cooperable, respectively, with the first and second folding rollers to form first and second folding devices; non-return feed means which prevent return movement of pliable strip material fed between the first and second folding rollers; and movable guide means mounted between the third and fourth folding rollers and capable of movement relative to the intermediate part of the folder means for directing the pliable strip material towards at least one of the spaced folding devices.

Because, in this form of construction, the intermediate part of the folder means remains stationary, it is possible to mount the movable guide means in this part of the machine for movement relative to the intermediate part of the folder means. One consequence of this arrangement is that the non-return feed means may be situated closer to the nips provided by the first and second folding devices, thus ensuring that there is less space for the pliable strip material to be deflected from its desired path so as to cause folding inaccuracies. Another consequence is that the limitations on the control and effectiveness of the movable guide means can be more easily overcome.

Thus, in one preferred embodiment of the invention, the movable guide means may be mounted for pivotal movement about an axis extending parallel to the axes of the first and second folding rollers for pivotal movement between a retracted position in which the movable guide means extend between the third and fourth folding rollers and a deflecting position in which the movable guide means obliquely intersect the axis of movement of the pliable strip material through the non-return feed means so as to deflect the pliable strip material towards one of the first and second folding devices. This movement may be affected by a reciprocable plunger such as a solenoid core or the piston of a piston-cylinder assembly fed with pressurised fluid, so as to operate independently of the drive means for rotating the first and second rollers.

With this form of construction, the pivotal axis of the guide means may be disposed on the opposite side of the intermediate part of the folder means to the non-return feed means; the intermediate part of the folder means may be formed with at least one elongate opening; and the movable guide means may be provided with a portion which is movable through the elongate opening in the intermediate part of the folder means on movement of the movable guide means from their retracted position to their deflecting position. Thus, where the movable guide means are provided with a series of fingers, the intermediate part of the folder means is provided with a plurality of parallel slots, each of which allows one of the fingers to move from one side of the intermediate part of the folder means to the other. With this form of construction, it is possible to form at least one of the feed rollers with a plurality of circumferentially extending grooves for receiving the tips of these fingers so as to ensure that the movable guide means are moved into suffeciently close proximity to the pliable strip material to deflect the leading edge of the strip material effectively into the folding nip provided by one of the first and second folding devices. With this form of construction, adequate deflection is provided by the guide means when in their deflecting position, but when the movable guide means are withdrawn to their retracted position, the passage of pliable strip material between the first and second folding devices is facilitated by the guidance provided by the intermediate part of the folder means.

In another preferred embodiment of the invention, the movable guide means are mounted for rotation about an axis extending parallel to the axes of the first and second folding rollers and disposed on the opposite side of the intermediate part of the folder means to the non-return feeding means. The intermediate part of the folder means is formed with at least one opening, through which part of the movable guide means extends, further drive means are provided for rotating the movable guide means in opposite directions; and the outer periphery of the movable guide means provides an irregular surface for alternately directing the pliable strip material towards the first and second folding devices.

To provide a suitably irregular surface, the movable guide means may comprise one or more series of spokes or radial projections having outer ends which are circumferentially spaced apart. A slot or opening may be formed in the intermediate part of the folder means to permit the outer extremities of the spokes of radial projections in each such series to extend into the axis of the path of movement of the pliable strip material through the non-return feed means. In an alternative arrangement, the movable guide means may comprise one or more discs having roughened peripheries and mounted so that parts of these peripheries extend through slots formed in the intermediate part of the folder means.

To improve the effectiveness of these rotary guide means, the guide means may be rotated at a greater circumferential speed than the first and second rollers. Thus, the circumferential speed of the rotary guide means may be three or four times as high as the circumferential speed of the first and second folding rollers.

Two embodiments of the invention are hereinafter described, by way of example, with reference to the accompanying drawings.

EXEMPLARY MODES FOR CARRYING OUT THE INVENTION

Figure 1:
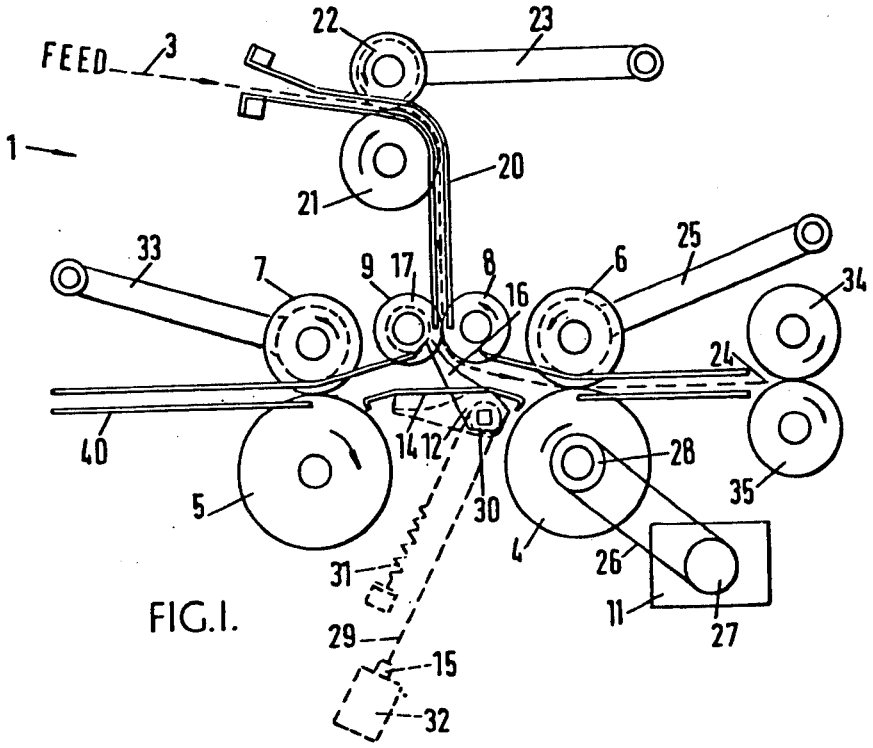
FIGS. 1, 2 and 3 are sectional side elevations of a first embodiment of the invention, showing three succesive stages in the Zig-Zag folding of a pliable strip material.
Figure 2:
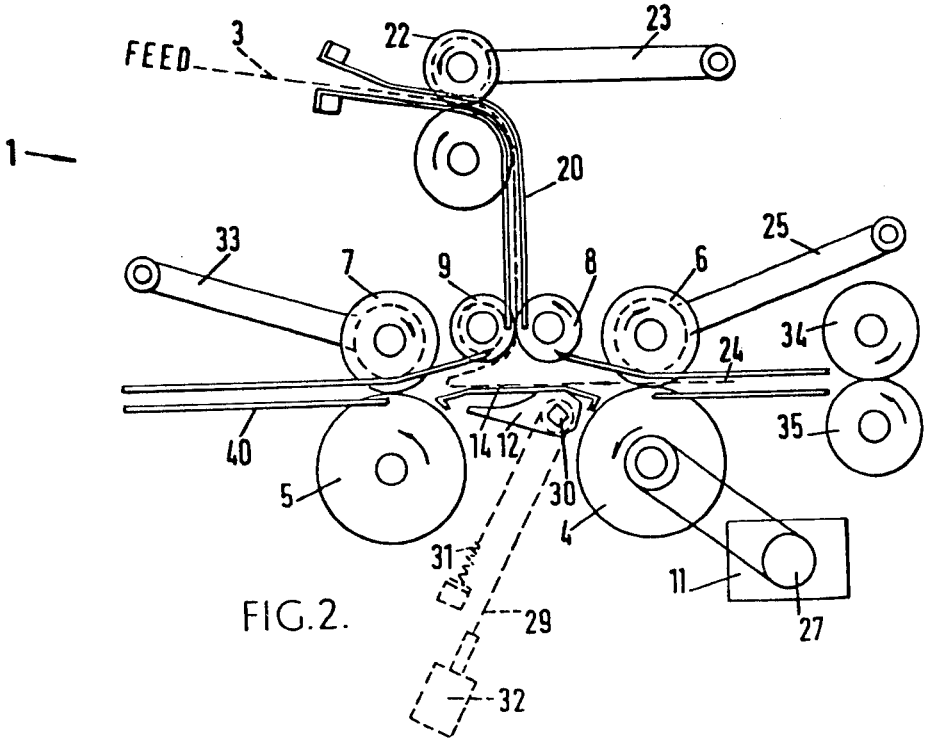
Figure 3:
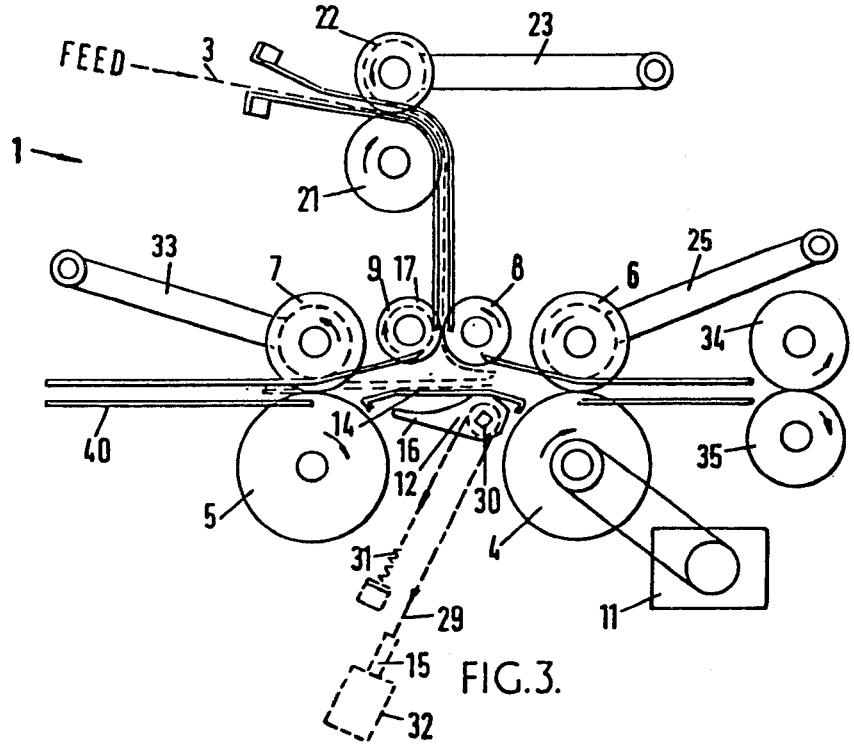

In the Zig-Zag folding machine 1, showing in FIGS. 1 to 3, pliable strip material 3 is fed, for example, from a printing machine (not shown), through a sheet metal guide 20 which is provided with recesses (not shown) so as to allow the strip material 3 to engage a freely rotable guide roller 21 and a clamping roller 22 mounted on a pivotal arm 23 so as to rest on the guide roller 21.

Feed rollers 8 and 9 are mounted at the outlet end of the guide 20 and are driven so as to feed the strip material 3 through the machine 1.

Movable guide means 12 are provided with a plurality of fingers 16 and, when in their position, as shown in FIG. 1, the fingers 16 intersect the axis of movement of the strip material 3 from the feed rollers 8 and 9 so as to deflect the leading end 24 of the strip material 3 into a folding nip between a first folding roller 6 and a third folding roller 4. The first folding roller 6 is mounted on a pivotal arm 25 so as to rest on the third folding roller 4 which is driven, as schematically shown, by a roller chain 26 and sprockets 27 and 28.

As shown, the movable guide means 12 are mounted for rotation on a shaft extending parallel to the axis of the first folding roller 6 and a roller chain 29 is trained around a sprocket 30 mounted on this shaft. One end of the roller chain 29 is connected to an anchored tension spring 31 and the other end of the roller chain 29 is connected to the core 15 of a solenoid 32 which, as shown in FIG. 1, has been actuated so as to extend the tension spring 31 and lift the fingers 16 of the movable guide means 12 upwards into the deflecting position of the movable guide means 12.

When suffecient sheet material 3 has been fed through the first folding device provided by the first and third folding rollers 6 and 4, the solenoid 32 is de-energised, thus allowing the tension spring 31 to withdraw the core 15 of the solenoid 32 so as to allow the movable guide means 12 to move into a retracted position as shown in broken outline in FIG. 1. At the same time, first and third folding rollers 6 and 4 are stoped and rotated by the prime mover 11 in the opposite direction.

As a result, both the feed rollers 8 and 9 and the first and third folding rollers 6 and 4 feed strip material towards each other so as to form a loop which moves away from the first folding device, as shown in FIG. 2. This loop is eventually fed into a folding nip between a second folding roller 7 and a fourth folding roller 5. Although not shown, transmission means connect the prime mover 11 to the fourth roller 5 so that the fourth roller 5 always rotates in the same direction as the third roller 4. Similarly, the second roller 7 is mounted on a pivotal arm 33 so as to rest on the fourth roller 5 and so the second folding roller 7 always rotates in the same direction as the first folding roller 6.

As the loop shown in FIG. 2 passes through the nip between the second and fourth folding rollers 7 and 5, a fold is formed in the strip material 3. The four folding rollers 4 to 7 are driven in the reverse direction, as shown in FIG. 2 until the leading end 24 of the strip material 3 is withdrawn from the nip between the first and third folding rollers 6 and 4. The folding rollers 4 to 7 are then stoped and, by means of the prime mover 11, are rotated in their original direction. As a result, a further loop is formed and this loop is eventually fed into the nip between the first and third folding rollers 6 and 4 so as to form a second fold. Third and subsequent folds are formed in a completely analogous manner so as to fold the pliable strip material 3 into a concertina-like formation, as shown in FIG. 3.

When the whole length of strip material 3 has been folded, the folding rollers 4 to 7 are rotated in the original direction, as shown in FIGS. 1 and 3, until the concertina-like formation is fed right through the nip between the first and third folding rollers 6 and 4. The folded formation is then ejected from the folding machine through discharge rollers 34 and 35. Although not shown, the feed rollers 8 and 9 and the discharge rollers 34 and 35 are all drivably connected to the prime mover 11.

The third and fourth folding rollers 4 and 5 constitute first and second parts of folder means which also include an intermediate part 14 in the form of a fixed guide extending between the third and fourth rollers 4 and 5 for supporting the strip material 3 and the concertina-like formation as the concertina-like formation is reciprocated between the first and second folding devices formed, respectively, by the first and third folding rollers 6 and 4 and the second and fourth folding rollers 7 and 5. However, as shown in FIGS. 1 to 3 the movable guide means 12 are mounted for pivotal oscillation about an axis disposed on the opposite side of the intermediate part 14 to the feed rollers 8 and 9, so as to allow the feed rollers 8 and 9 to be located as close as possible to the intermediate part 14. Therefore, in order to allow the movable guide means 12 to move from their retracted position to their deflecting position, the intermediate part 14 is formed with a plurality of elongate slots through which the fingers 16 are able to pass.

Similarly, a plurality of circumferential grooves 17 are formed in the feed roller 9 so as to accommodate the extremities of the fingers 16, thus permitting the movable guide means to be moved into a deflecting position in which they are most effective in deflecting the leading end 24 of the pliable strip material 3.

Figure 4:
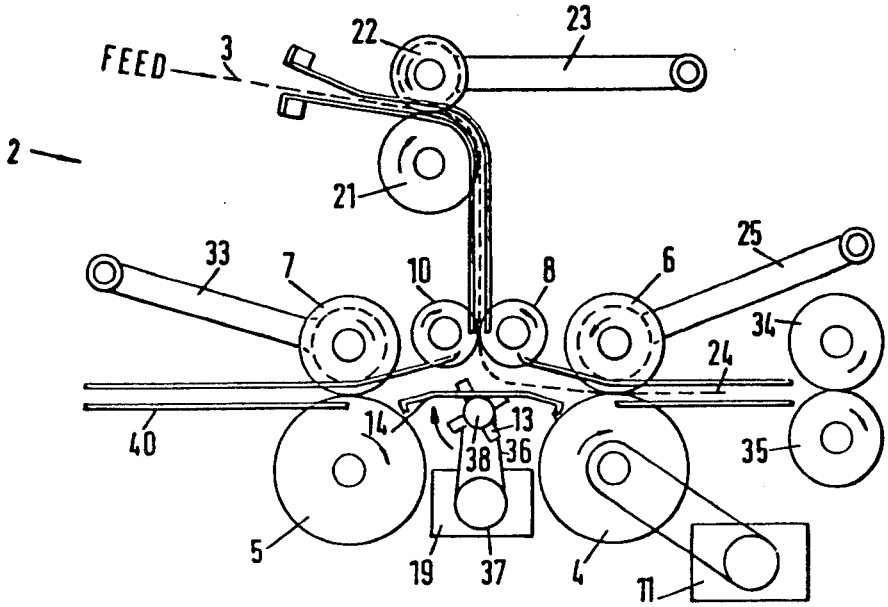
FIGS. 4 and 5 are sectional side elevations of a second embodiment of the invention, showing two sucessive stages in the folding operation.
Figure 5:
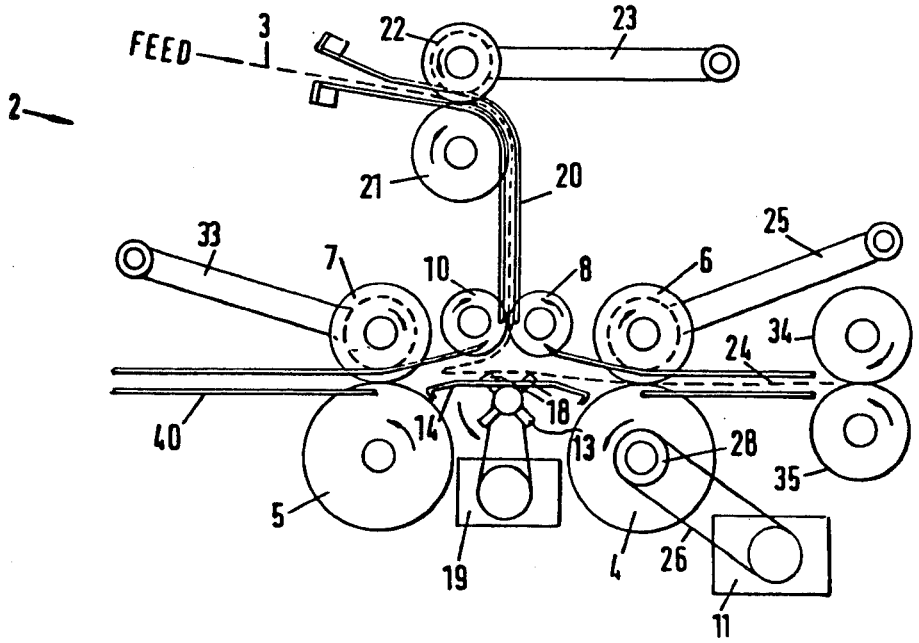

In the Zig-Zag folding machine 2 constituting the second embodiment of the invention illustrated in FIGS. 4 and 5, much of the machine is identical to the machine 1 shown in FIGS. 1 to 3 and corresponding reference numerals have been assigned to like parts. However, in this second embodiment, the movable guide means are in the form of rotary guide means 13 driven by a second prime mover 19 which, as shown schematically, is connected to the rotary guide means 13 by means of a roller chain 36 and sprockets 38 and 37 so that the peripheral speed of the rotary guide means 13 is three times the peripheral speed of the four folding rollers 4 to 7.

In operation, the rotary guide means 13 always rotate in the same direction as the third and fourth folding rollers 4 and 5 and so, when the leading end 24 of the pliable strip material 3 is fed between the feed rollers 8 and 10, which in this case both have uniterrupted cylindrical surfaces, the leading end 24 is flicked towards the nip between the first and third folding rollers 6 and 4 so as to ensure that the length of strip material 3 between the free end 24 and the first fold can be accurately controlled.

When the folding rollers 4 to 7 are rotated in the reverse direction, so too is the rotary guide means 13, thus assisting in the formation of a loop, as shown in FIG. 5, which is fed into the folding nip between the second and fourth folding rollers 7 and 5 to form the first fold. One beneficial effect of the high speed rotation of the rotary guide means 13 is that the pliable strip material 3 is kept taut.

The rotary guide means 13 comprise a series of axially spaced sets of radial projections which have outer ends 18. As shown in FIGS. 4 and 5 each set comprises four equiangularly spaced radial projections or spokes and these radial projections or spokes extend through slots formed in the intermediate part 14 extending between the third and fourth folding rollers 4 and 5 so that the extremities of these radial projections or spokes are able to engage the strip material 3. Thus it will be appreciated that, as noted previously herein, the radial projections or spokes provide an irregular surface for alternately directing the strip material 3 toward the first and second folding devices 4, 6 and 5, 7.

As shown in the drawings, both machines 1 and 2 are provided with sheet metal guide means 40 for supporting the pliable strip material 3 and the concertina-like formation produced by the machine. As shown, the upper parts of these guide means 40 extending between the feed rollers 8 and 9 or 10 and the first and second folding devices 4, 6 and 5, 7 also cooperate with the intermediate part 14 extending between the third and fourth rollers 4 and 5 to direct loops formed in the pliable strip material 3 into the nips provided by the two folding devices.

Although reference numerals have been used in the appended claims, to improve the intelligibility of these claims, it is expressly stated that these reference numerals should not be construed as limiting the claims to the constructions illustrated in the accompanying drawings.

I claim:

1. A Zig-Zag folding machine (1 or 2), for the concertina-like folding of pliable strip material (3), comprising:

folder means having first and second parts (4 and 5);

first and second spaced folding rollers (6 and 7) rotatable about parallel axes and respectively cooperable with the first and second parts (4 and 5) of the folder means to form first and second folding devices (4, 6 and 5, 7);

non-return feed means (8 and 9 or 10) which prevent return movement of pliable strip material (3) fed between the first and second spaced folding rollers (6 and 7);

drive means (11) operable to drive the first and second rollers (6 and 7), directly or indirectly, alternately both in one direction and then both in the opposite direction; and movable guide means (12 or 13) for directing the pliable strip material (3) towards at least one of the spaced folding devices (4, 6 and 5, 7);

characterized in that:

the first and second parts of the folder means comprise third and fourth folding rollers (4 and 5);

the folder means include an intermediate part (14) extending between the third and fourth folding rollers (4 and 5); and the movable guide means (12 or 13) are mounted between the third and fourth folding rollers (4 and 5) for movement relative to the intermediate part (14) of the folder means by turning about an axis extending parallel to the axes of the first and second folding rollers (6 and 7) and disposed on the side of the intermediate part (14) opposite to the non-return feed means (8 and 9 or 10).

2. A machine (1), according to claim 1, characterized in that the movable guide means (12) are mounted for pivotal movement about the turning axis between a retracted position in which the movable guide means (12) extend between the third and fourth folding rollers (4 and 5) of the folder means and a deflecting position in which the movable guide means (12) obliquely intersect the axis of movement of the pliable strip material (3) through the non-return feed means (8 and 9) and deflect the pliable strip material (3) towards one of the first and second folding devices (4, 6 and 5, 7).

3. A machine (1), according to claim 2, characterized in that the movable guide means (12) are operated by a reciprocable plunger (15), independently of the drive means (11) for the first and second folding rollers (6 and 7).

4. A machine (1), according to claim 2, characterized in that:

the intermediate part (14) of the folder means is formed with at least one elongate opening, and the movable guide means (12) are provided with a portion (16) which is movable through the elongate opening in the intermediate part (14) of the folder means on movement of the movable guide means (12) from their retracted position to their deflecting position.

5. A machine (1), according to claim 4, characterized in that:

the movable guide means (12) are provided with a plurality of said portions in the form of fingers (16);

the intermediate part (14) of the folder means is formed with a plurality of elongate openings;

the non-return feed means comprise two feed rollers (8 and 9), at least one of which is positively driven; and at least one (9) of the feed rollers (8 and 9) is formed with a plurality of circumferentially extending grooves (17) for receiving the fingers (16) of the movable guide means (12).

6. A machine (2), according to claim 1, characterized in that:

the movable guide means (13) are mounted for rotation about the turning axis;

further drive means (19) are provided for rotating the movable guide means (13) in opposite directions; and the outer periphery of the movable guide means (13) provides an irregular surface for alternately directing the pliable strip material (3) towards the first and second folding devices (4, 6 and 5, 7).

7. A machine (2), according to claim 6, characterized in that the movable guide means (13) rotates with a greater circumferential speed than the first and second folding rollers (6 and 7).

8. A machine (2), according to claim 6, characterized in that:

the movable guide means (13) have spaced radial projections with outer ends (18), for providing said irregular surface, and the intermediate part (14) of the folder means is formed with a plurality of slots for permitting, by passage therethrough, the outer ends (18) of the radial projections to engage the pliable strip material (3).

* * * * *